US008212737B2

(12) United States Patent
Skottke et al.

(10) Patent No.: US 8,212,737 B2
(45) Date of Patent: Jul. 3, 2012

(54) ANTENNA UNIT

(75) Inventors: Patrik Skottke, Upplands Väsby (SE); Zoltan Palankai, Stockholm (SE); Mattias Hellgren, Åkersberga (SE)

(73) Assignee: Smarteq Wireless AB, Enebyberg (SE)

( * ) Notice: Subject to any disclaimer, the term of this patent is extended or adjusted under 35 U.S.C. 154(b) by 347 days.

(21) Appl. No.: 12/458,607

(22) Filed: Jul. 16, 2009

(65) Prior Publication Data

US 2010/0013733 A1 Jan. 21, 2010

(51) Int. Cl.
*H01Q 1/12* (2006.01)
*H01Q 1/32* (2006.01)

(52) U.S. Cl. ..... 343/878; 343/711; 343/713; 343/715

(58) Field of Classification Search ..... 343/711, 343/713, 715, 878
See application file for complete search history.

(56) References Cited

U.S. PATENT DOCUMENTS

| | | | | |
|---|---|---|---|---|
| 6,236,377 | B1 | 5/2001 | Hussaini et al. | |
| 6,509,878 | B1 * | 1/2003 | Tornatta et al. | 343/715 |
| 6,747,603 | B1 * | 6/2004 | Tornatta et al. | 343/715 |
| 7,358,910 | B2 * | 4/2008 | Blickle | 343/713 |
| 2003/0089834 | A1 | 5/2003 | Hough | |
| 2007/0075904 | A1 | 4/2007 | Blickle | |

FOREIGN PATENT DOCUMENTS

| | | |
|---|---|---|
| DE | 202 03 914 | 6/2002 |
| EP | 1 760 826 | 7/2007 |
| EP | 1 928 054 | 6/2008 |

OTHER PUBLICATIONS

European Search Report Application No. EP09165617, dated Oct. 9, 2009.

European Communication pursuant to Article 94(3) EPC for Application No. EP09165617.3, dated Aug. 17, 2010.

* cited by examiner

*Primary Examiner* — Hoang V Nguyen
(74) *Attorney, Agent, or Firm* — Nixon & Vanderhye P.C.

(57) ABSTRACT

The present invention relates to an antenna unit (10) for mounting on a mounting surface from a first side of the mounting surface. The antenna unit (10) comprises an element (12) comprising a first side (14) abutting against the mounting surface when the antenna unit (10) is mounted, and a second side (16) arranged parallel to and opposite the first side (14). The antenna unit (10) comprises an antenna mount (18) comprising an attachment member (22) in turn comprising a threaded hole (20) in which a bolt member (24) is applied. The bolt member (24) is manipulated by a tool (26) from the first side of the mounting surface. In a first end position of the attachment member (22), the same is applicable through a hole intended therefor in the mounting surface. In a second end position, when the bolt member (24) has been tightened by the tool (26), the attachment member (22) presses/clamps the antenna unit (10) against the first side of the mounting surface.

17 Claims, 9 Drawing Sheets

ANTENNA UNIT

This application claims priority to Sweden Application No. 0801705-5, filed 17 Jul. 2008, the entire contents of which are hereby incorporated by reference.

FIELD OF THE INVENTION

The present invention relates to an antenna unit for mounting on a mounting surface from a first side of the mounting surface.

BACKGROUND OF THE INVENTION

Combination antennas but also traditional antenna mounts are mounted in a round hole having a diameter of approx. 14-20 mm. The mount has a corresponding bolt that fits the dimension of the hole. Occasionally, also adapter rings are found to adapt the bolt to the dimension of the hole. The antenna is attached by a toothed plate connector and a nut being mounted from the underside and tightened.

A disadvantage of this mounting is that the antenna needs to be aligned/orientated since the hole is round. In addition, the fitting is carried out from two directions. The antenna is difficult to hold in place by one person during the fitting of the nut. Upon fitting in great vehicles, the installation engineer needs to work with the hands high stretched over the head, which from working-environment point of view is not allowed. In serial production today, antennas of this type are mounted by two persons, which is not cost-effective.

Another known antenna mount is designed in such a way that it is possible to mount from the outside by it being angled/threaded down into a round hole having a diameter of approx. 20 mm. Then, the gasket and nut are mounted to tighten the mount. Finally, a flexible section and the antenna are mounted. The mounting is normally used only for rod antennas, since the proper mount has to be small both on the inside and the outside.

A disadvantage of this mounting is that the antenna needs to be aligned/orientated since the hole is round, unless the antenna is symmetrical. In addition, the antenna is difficult to hold in place, at the same time as the gasket and nut are threaded in place. There is a risk that the orientation is changed when the nut is tightened. An additional disadvantage is that the antenna mount comes with a plurality of loose parts in a bag. In serial production, the parts are picked out of the bag and are laid in a trough that then is moved out to the vehicle, which is not cost-effective. Furthermore, a part may easily be lost and an entire antenna needs to be discarded. During fitting, several parts may be lost and disappear alternatively get into places in the vehicle or in the mechanics of conveyor belts, in line production, and create problems.

An alternative mounting of this antenna mount is that the mount is mounted from the underside and the nut from the upperside.

An additional disadvantage of this mounting is that the fitting is carried out from two directions. This means that in serial production, antennas of this type are today mounted by two persons, which is not cost-effective.

Another known way is to mount the mount/antenna on the vehicle using adhesive/tape. This type of mounting is found in fitting of so-called shark fins on vehicles.

A disadvantage of this way of mounting is that the antenna needs to be aligned/orientated. In serial production, a robot is required that presses the antenna in place in a controlled way using the correct pressure and position. In addition, it is extremely important that the surface is cleaned before the tape is mounted. An additional disadvantage is that if the antenna is damaged, it is difficult to dismount the unit. The antenna mount cannot be equipped with long rods. The torque becomes great and there is a risk that the mount gets loose over time. An additional disadvantage is that it cannot be mounted in all temperatures.

The patent document US-2007/0075904 A1 discloses a method for the attachment of an antenna to a surface. The surface is a pressed surface where a self-tapping screw is mounted through the sheet-metal plate, alternatively a press nut or clip on is used.

The disadvantage of this is that the installation requires that the fitting surface is machined in a special way in the production, on one hand because of the pressing but also further fitting of press nut, which requires more time and consequently higher costs. An additional disadvantage is that all force is located around one position, which makes that rods for lower frequencies presumably cannot be mounted. The machining of the surface requires great presses and cannot be carried out afterwards.

The patent document EP-1, 928, 054 A1 discloses an antenna that is fixed by a snap until it is possible to fix the antenna by a screw from the underside.

The solution is inappropriate in respect of a mounting sequence with a screw from the underside. In addition, it is not possible to dismount the antenna without special tools or destroying the snap. Furthermore, the solution is not suitable in antenna configurations that require longer rods and accordingly greater forces upon the fastening.

The patent document US-2003/0089834 A1 discloses a method of temporary attaching an antenna so that it does not "falls out of" the hole upon fitting with the nut on the inside.

The method is not applicable for permanent fastening but requires an additional attachment according to traditional methods, so called "threaded bolt".

SUMMARY OF THE INVENTION

The above-mentioned problems are solved by an antenna unit for mounting on a mounting surface from a first side of the mounting surface according to claim 1. The antenna unit comprises an element comprising a first side, which abuts against the mounting surface when the antenna unit is mounted, and a second side arranged parallel to and opposite the first side. Furthermore, the antenna unit comprises an antenna mount comprising an attachment member provided with a threaded or non-threaded hole and arranged adjacent to the first side, as well as a bolt member provided with a thread and applied in the threaded or non-threaded hole. The head of the bolt member has an essentially constant distance to the other side. The bolt member is manipulated by a tool from the first side of the mounting surface in such a way that the attachment member, in a first end position, is displaced in two dimensions in relation to the first side so that the attachment member is applicable through a hole intended therefor in the mounting surface, as well as a second end position, when the bolt member is arranged in relation to the first and second sides of the element at an angle, $\alpha<90°$, and the attachment member presses/clamps the antenna unit against the first side of the mounting surface.

An advantage of this antenna unit according to the present invention is that mounting can be effected by one person both upon installation and repair. An additional advantage is that the mounting is carried out from one side. In addition, only one tool is needed for the mounting. The antenna is delivered as one unit, which means that no loose parts are present. An additional advantage is that it is easy to dismount a damaged antenna.

In this connection, an additional advantage is obtained if the first side comprises mounting lugs adapted to the hole in the mounting surface so that a mounted antenna unit is positioned/aligned/located.

In this connection, an additional advantage is obtained if the attachment member comprises a locking member arranged in the threaded or non-threaded hole so that the bolt member cannot be loosened from the attachment member, defining the first end position.

Thereby, the advantage is obtained that the antenna unit remains one unit without any loose parts.

According to another embodiment, an advantage is obtained if the bolt member is a self-tapping screw.

In this connection, an additional advantage is obtained if the antenna mount furthermore comprises an elongate wedge member that is fixedly arranged in the first side and has a wedge-shaped cross-section in a plane parallel to the longitudinal direction of the antenna unit as well as is elongate in a plane perpendicular in relation to the longitudinal direction of the antenna unit, where the width of the wedge-shaped cross-section increases with the distance from the first side.

In this connection, an additional advantage is obtained if the attachment member has a wedge-shaped cross-section in a plane parallel to the longitudinal direction of the antenna unit and is elongate in a plane perpendicular in relation to the longitudinal direction of the antenna unit, where the width of the wedge-shaped cross-section is smallest closest to the first side and greatest at the greatest distance from the first side.

In this connection, an additional advantage is obtained if the first side furthermore comprises two lug members, each arranged abutting against the short sides of the attachment member having wedge-shaped cross-section, so that the attachment member does not rotate when the bolt member is manipulated by the tool.

In this connection, an additional advantage is obtained if the bolt member with the head thereof is arranged in a fixing member connected with the other side and arranged in relation to the other side at an angle, $\alpha<90°$, the attachment member being displaced linearly along the bolt member when the same is manipulated by the tool.

According to another embodiment, an advantage is obtained if the attachment member comprises an abutment part provided with the non-threaded hole as well as two arm members, and if the abutment part comprises a cylinder member movably arranged in the abutment part, which cylinder member has a longitudinal axis direction perpendicular in relation to the longitudinal axis direction of the bolt member, and if the cylinder member comprises a threaded hole that is arranged in the hole and in which the bolt member is applied, one end of each arm member being fixedly anchored in the abutment part on each side of the non-threaded hole in such a way that the arm members are arranged at an angle, $\beta<90°$, in relation to the plane of the abutment part that abuts against the mounting surface in the second end position, and if each arm member comprises a first pin member each, either facing each other or facing away from each other, and if the bolt member with the head thereof is arranged in a fixing member connected with the other side, which fixing member furthermore comprises two first guiding grooves facing away from each other and in which the first pin members are running.

In this connection, an additional advantage is obtained if the first guiding grooves describe a curve in such a way that the abutment plane of the abutment part, in the second end position, is parallel to the first side, and if, in the first end position, the abutment plane of the abutment part is arranged at an angle, $\gamma<45°$, in relation to the first side and the bolt member is essentially arranged perpendicularly in relation to the first side.

In this connection, an additional advantage is obtained if each arm member furthermore comprises a second pin member arranged on the opposite side of the arm member in relation to the first pin member, and if the first pin member is displaced in the longitudinal direction of the arm member in relation to the second pin member, and if the fixing member furthermore comprises two second guiding grooves facing away from each other and in which the second pin members are running.

In this connection, an additional advantage is obtained if the first pin members are smaller than the second pin members.

In this connection, an additional advantage is obtained if the first pin members face each other and the second pin members face away from each other and are arranged at one end of the arm members.

In this connection, an additional advantage is obtained if the first guiding grooves have a width that is smaller than the width of the second guiding grooves, and if the second guiding grooves have a smallest width at the greatest distance from the first side and a greatest width adjacent to the first side and the first guiding grooves are of uniform width and describe an arch in relation to the second guiding grooves.

In this connection, an additional advantage is obtained if the antenna unit furthermore comprises an outer part arranged on the fixing member and comprising interior guiding grooves, in which the second pin members furthermore are running.

In this connection, an additional advantage is obtained if the abutment part has an extension so that, in the second end position, the abutment part has contact points on opposite sides of the hole in the mounting surface.

Embodiments of the invention will now be described, reference being made to the accompanying drawings, wherein:

DETAILED DESCRIPTION OF PREFERRED EMBODIMENTS

Figure 1:
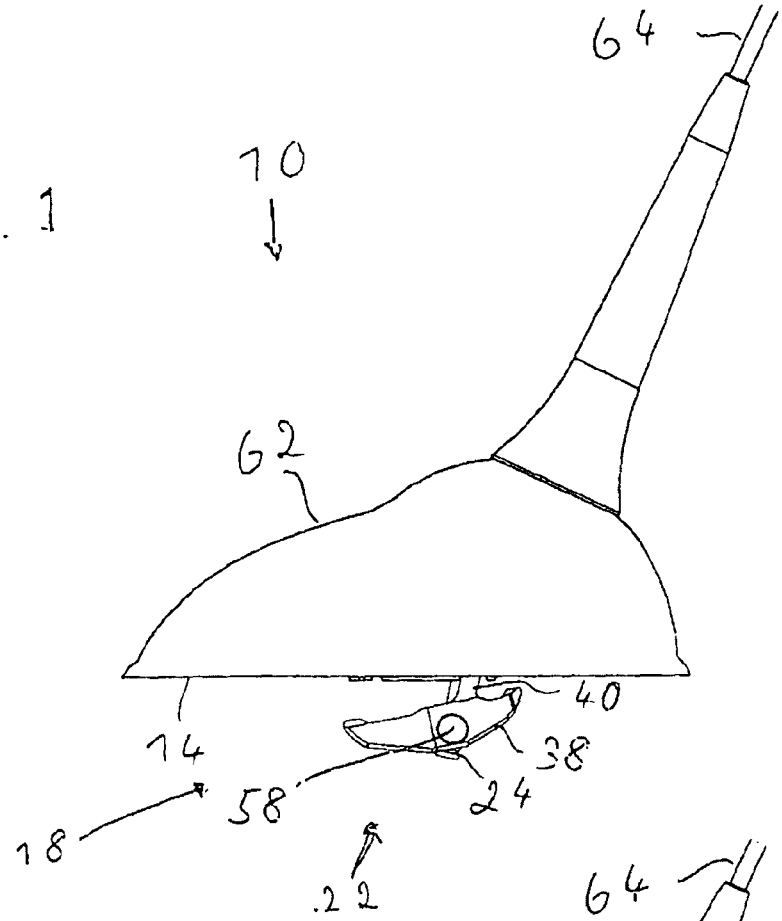
FIG. 1 is a side view of a first embodiment of an antenna unit according to the present invention.
Figure 2:
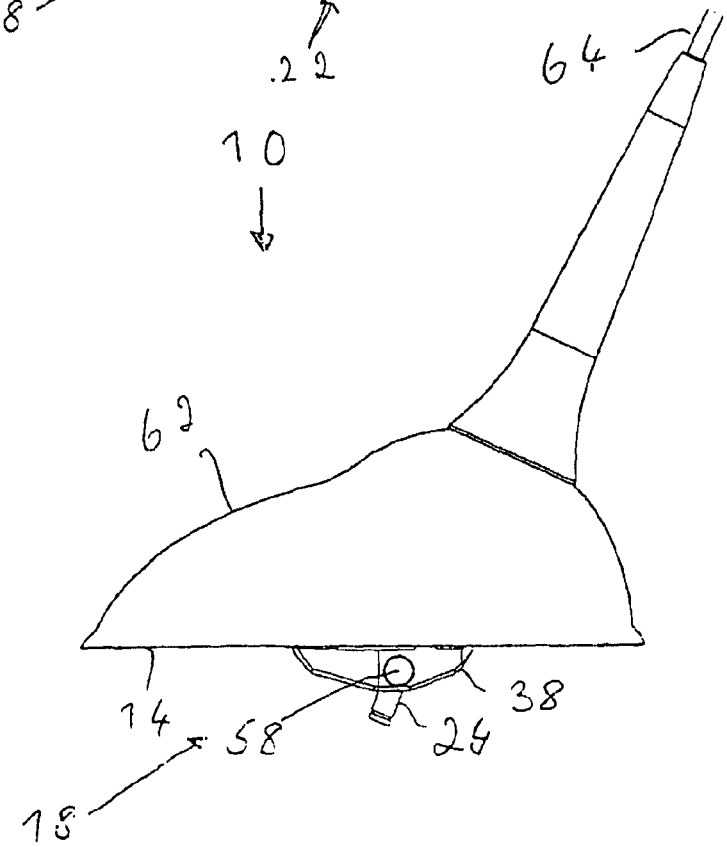
FIG. 2 is an additional side view of the antenna unit shown in FIG. 1.

In FIG. 1, a side view is shown of a first embodiment of an antenna unit 10 according to the present invention. In this figure, the antenna unit 10 is shown with the antenna housing 62 and the external radiator/antenna 64 mounted. The antenna unit 10 is intended for mounting on a mounting surface from a first side of the mounting surface. The antenna unit 10 comprises an element 12 (compare for instance FIGS. 3 and 4) comprising a first side 14, which abuts against the mounting surface when the antenna unit 10 is mounted. The element 12 comprises furthermore a second side 16 (compare for instance FIGS. 3 and 4) arranged parallel to and opposite the first side 14. The antenna unit 10 comprises furthermore an antenna mount 18 comprising an attachment member 22 arranged adjacent to the first side 14. The antenna mount 18 comprises furthermore a bolt member 24 provided with a thread. The attachment member 22 comprises in turn an abutment part 38 provided with a non-threaded hole 20 (compare for instance FIG. 6) as well as two arm members 40. The bolt member 24 is applied in the non-threaded hole 20. In FIG. 1, a cylinder member 58 is also seen, which is included in the abutment part 38. The cylinder member 58 can move in relation to the abutment part 38. The cylinder member 58 is movable around the longitudinal axis line thereof and comprises a hole provided with a thread and in which the bolt member 24 is applied. Since the bolt member 24 also is arranged in the non-threaded hole 20, which has a greater diameter than the bolt member 24 has, the abutment part 38 can be moved between the positions shown in FIG. 1 and FIG. 2, respectively. As is seen in FIGS. 1 and 2, the cylinder member 58 has a longitudinal axis direction perpendicular in relation to the longitudinal axis direction of the bolt member 24. In FIG. 1, the first end position is shown, when the attachment member 22 is displaced in two dimensions in relation to the first side 14 so that the attachment member 22 is applicable through a hole intended therefor (compare FIG. 18) in the mounting surface. Differently stated, it may be said that the attachment member 22 is turned and opens up in relation to the first side 14 so that the attachment member 22 can be threaded into the hole in the mounting surface.

In FIG. 2, an additional side view is shown of the antenna unit 10 shown in FIG. 1 according to the present invention. In FIG. 2, the attachment member 22 is shown in the second end position, when the bolt member 24 is arranged in relation to the first and second sides 14, 16 of the element 12 at an angle, $\alpha<90°$, and the attachment member 22 presses the antenna unit 10 in place against the first side of the mounting surface. This means that the mounting surface is between the first side 14 of the element 12 and the abutment part 38.

Figure 3:
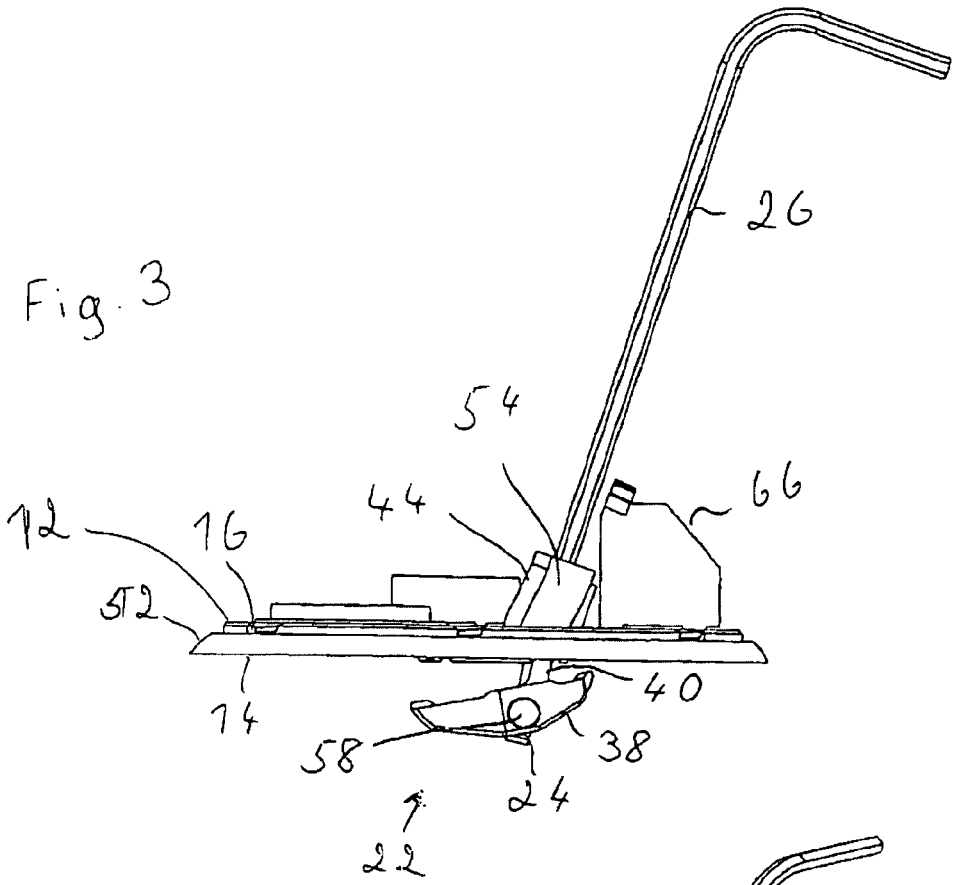
FIG. 3 is a side view of parts of the antenna unit shown in FIG. 1.

In FIG. 3, a side view is shown of parts of the antenna unit 10 shown in FIG. 1. In order to clarify the mounting of the antenna unit 10, the antenna housing 62 and the external radiator/antenna 64 are not shown in this figure. Also in this figure, the attachment member 22 is shown in the first end position, such as in FIG. 1. In addition, a gasket 52 is seen arranged around the element 12 for sealing against the mounting surface. Furthermore, an upright printed circuit card 66 is seen, which for instance may be used for mobile telephone antenna and amplifier for the external radiator 64. In addition, a fixing member 44 is seen in which the bolt member 24 with the head thereof is arranged. In addition, an outer part 54 is shown, which is arranged on the fixing member 44 and is described further in connection with FIG. 8. In FIG. 3, it is seen how the bolt member 24 is manipulated by means of a tool 26, in this specific case a hex head wrench 26. The head of the bolt member 24 is accessible via a hole in the outer part 54. It should be pointed out that the antenna unit 10 can be mounted even if the antenna housing 62 is mounted.

Figure 4:
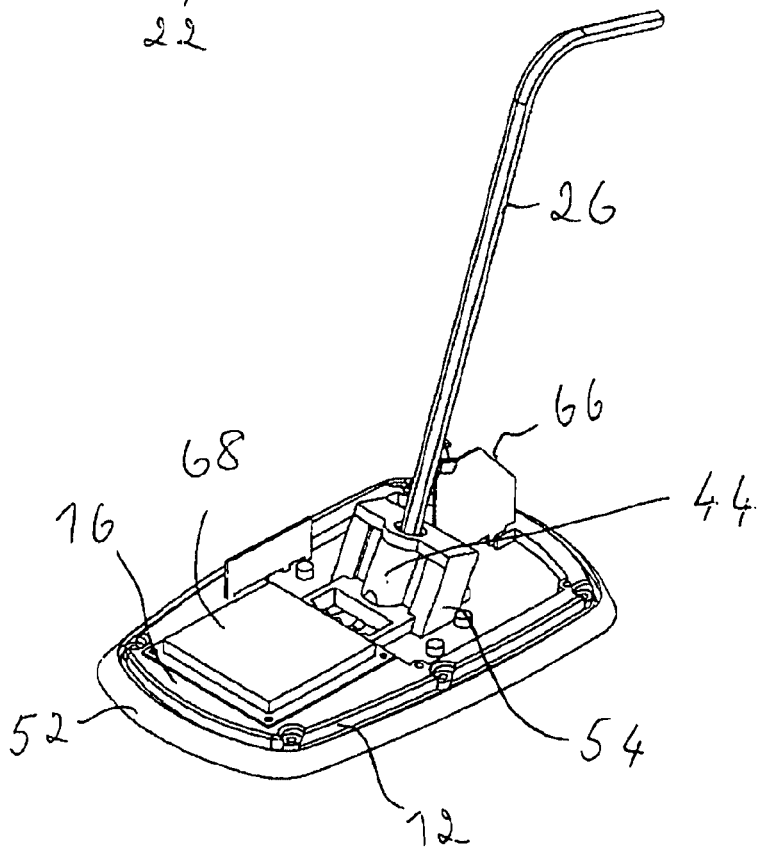
FIG. 4 shows a perspective view of the antenna unit shown in FIG. 3.

In FIG. 4, a perspective view is shown of the antenna unit 10 shown in FIG. 3. Here, it is clearly shown how a circuit 68 may be mounted on the second side 16 of the element 12.

Figure 5:
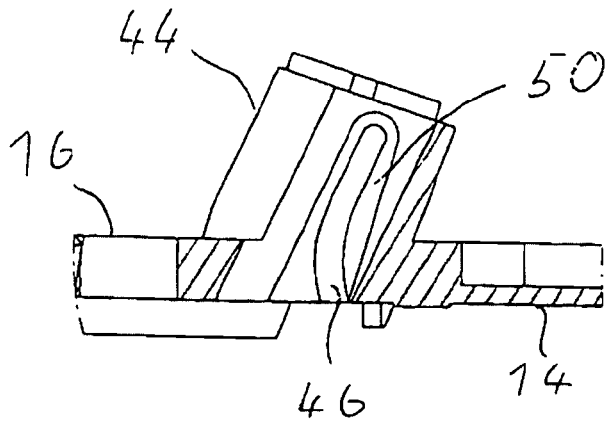
FIG. 5 is a side view, partly in section, which shows a portion of the antenna unit shown in FIG. 1.

In FIG. 5, a side view is shown, partly in section, of a portion of the antenna unit 1 shown in FIG. 1. In this figure, the fixing member 44 is above all shown comprising a first guiding groove 46, and a second guiding groove 50. Even if it is not seen in FIG. 5, the fixing member 44 comprises two first guiding grooves 46 and two second guiding grooves 50, where the first guiding grooves 46 face away from each other and the second guiding grooves 50 also face away from each other. As is seen in FIG. 5, the first guiding grooves 46 have a width that is smaller than the width of the second guiding grooves 50. In addition, the second guiding grooves 50 have a smallest width at the greatest distance from the first side 14 and a greatest width adjacent to the first side 14. The first guiding grooves 46 are, however, of uniform width and describe an arch in relation to the second guiding grooves 50. In addition, it is pointed out that the first guiding groove 46 lies deeper than the second guiding groove 50, i.e., the second guiding groove 50 lies closer to the section in the figure than the first guiding groove 46 does.

Figure 6:
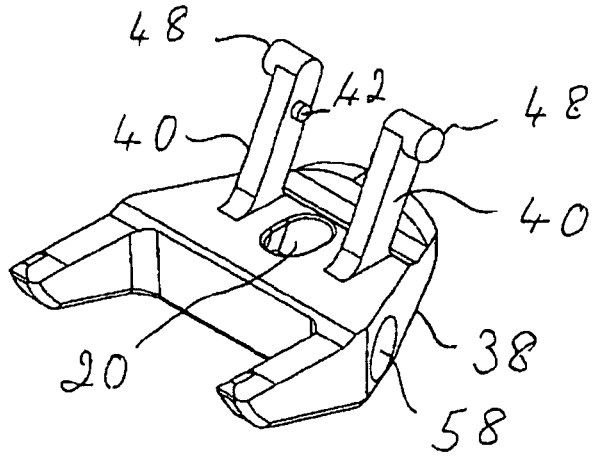
FIG. 6 shows a perspective view of an abutment part included in the antenna unit shown in FIG. 1.
Figure 7:
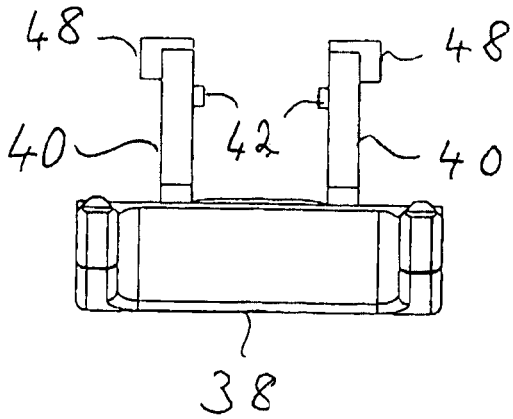
FIG. 7 is a side view of the abutment part shown in FIG. 6.

In FIG. 6, a perspective view is shown of the abutment part 38 included in the antenna unit 10 shown in FIG. 1. In this figure, the upper part of the non-threaded hole 20 is clearly shown, which in the end shown closest is oval, with the purpose of being able to house the bolt member 24 when it is moved when it is manipulated by means of the tool 26. The abutment part 38 comprises furthermore two arm members 40, which are fixedly anchored in the abutment part 38 on each side of the hole 20. As is seen from this figure, each arm member 40 comprises a first pin member 42. This is seen more clearly in FIG. 7, which shows a side view of the same abutment part 38. In the embodiment illustrated, the two first pin members 42 face each other. They may also face away from each other. Each arm member 40 comprises furthermore a second pin member 48 arranged on the opposite side of the arm member 40 in relation to the first pin member 42. In this shown embodiment, the second pin members 48 face away from each other. In addition, the first pin members 42 are displaced in the longitudinal direction of the arm members 40 in relation to the second pin members 48. Such as furthermore is clearly seen in the same figures, the first pin members 42 are smaller than the second pin members 48. In this specific embodiment, the second pin members 48 are arranged at one end of each arm member 40. In this shown embodiment, and with a reference to FIG. 5, the first pin members 42 are running in the first guiding grooves 46. The second pin members 48 are running in the second guiding grooves 50.

Figure 8:
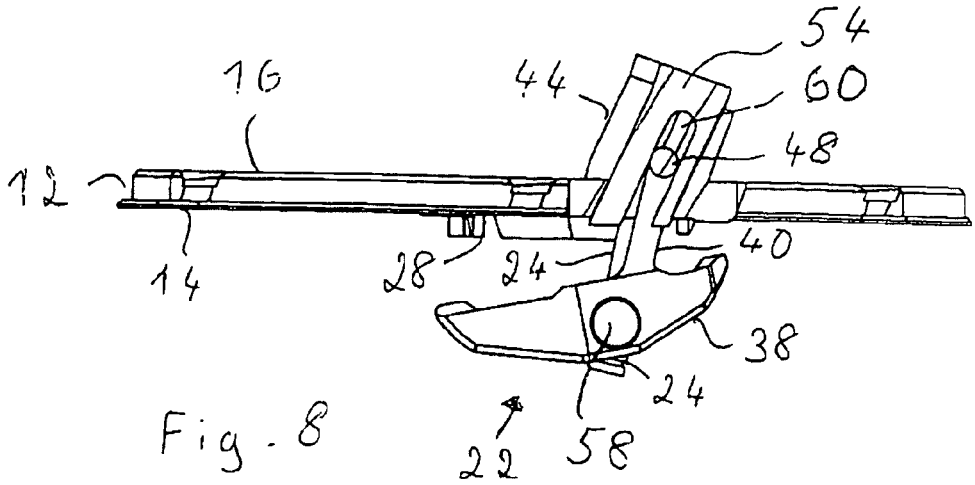
FIG. 8 is a side view, partly in section, which shows parts of the antenna unit shown in FIG. 1.

In FIG. 8, a side view is shown, partly in section, of parts of the antenna unit 10 shown in FIG. 1. Many parts in this figure have been previously shown and have been indicated using the same reference designations and will accordingly not once again be described in detail. In this figure, a section is shown through the outer part 54, which is arranged on the fixing member 44. As is seen of this section, the outer part 54 comprises interior guiding grooves 60 in which the second pin members 48 furthermore are running. This means that the second pin members 48 are running in two different guiding grooves 50 and 60, respectively. This entails that the guiding of the abutment part 38 is improved. It should, however, be pointed out that the solution works with only one guiding groove and obviously also with two guiding grooves.

Figure 9:
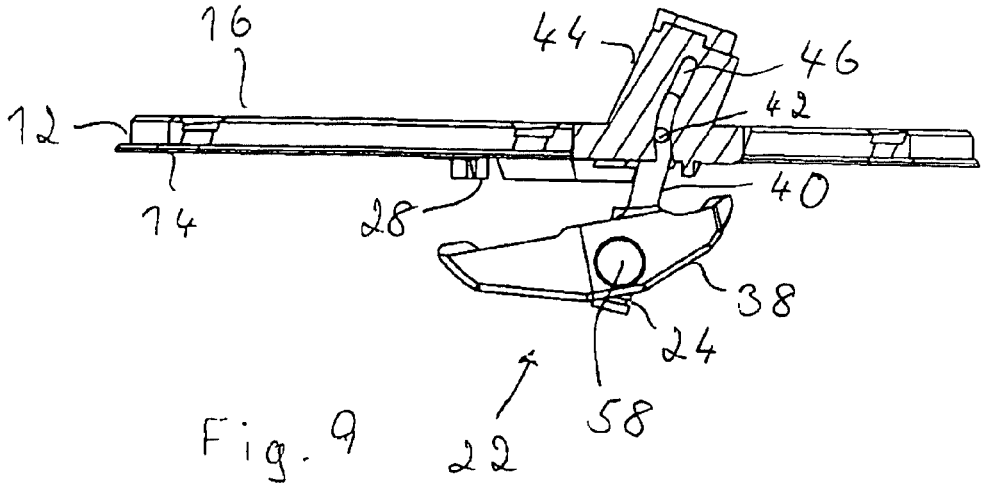
FIG. 9 is a side view, partly in section, which shows another section than the one shown in FIG. 8.

In FIG. 9, a side view is shown, partly in section, of the antenna unit 10 shown in FIG. 1. In comparison with FIG. 8, FIG. 9 shows, however, another section. Here, the section is through the fixing member 44, and therefore the first guiding grooves 46 are seen as describing an arch, and the first pin members 42 running therein. In addition, it is seen in FIG. 9 and FIG. 8 that the first side 14 comprises mounting lugs 28 that are adapted to the hole in the mounting surface. The abutment part 38 has an extension so that, in the second end position, shown in FIG. 2, the abutment part 38 has contact points on opposite sides of the hole in the mounting surface and accordingly past the mounting lugs 28. Compare also FIGS. 12 and 13. In the first end position, which is shown in for instance FIGS. 8 and 9, the abutment plane of the abutment part 38 is arranged at an angle, $\gamma<45°$, in relation to the first side 14 and the bolt member 24 is essentially arranged perpendicularly in relation to the first side 14.

Figure 10:
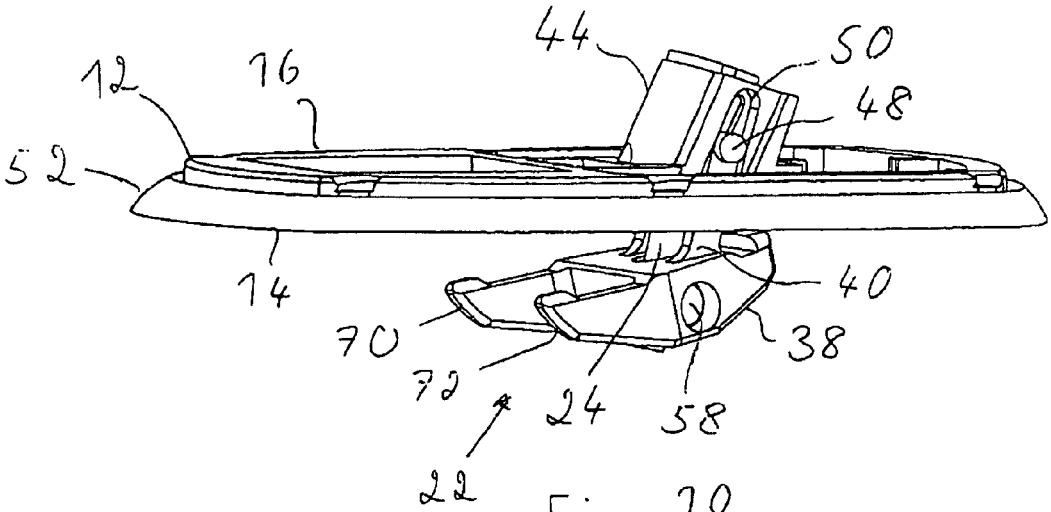
FIG. 10 shows a perspective view of parts of the antenna unit shown in FIG. 1.
Figure 11:
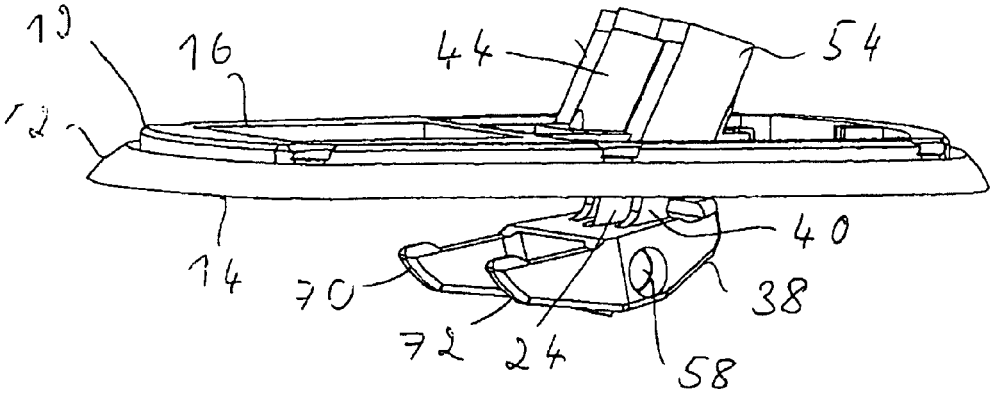
FIG. 11 shows another perspective view of parts of the antenna unit shown in FIG. 1.

In FIGS. 10 and 11, different perspective views are shown of parts of the antenna unit 10 shown in FIG. 1. What is seen extra clearly in these figures is how the bolt member 24 relates to the arm members 40. In addition, it is clearly seen that the abutment part 38 comprises two legs 70 and 72, in order to obtain a great extension without because of this cover the opening 34 in the element 12 (compare FIG. 12).

Figure 12:
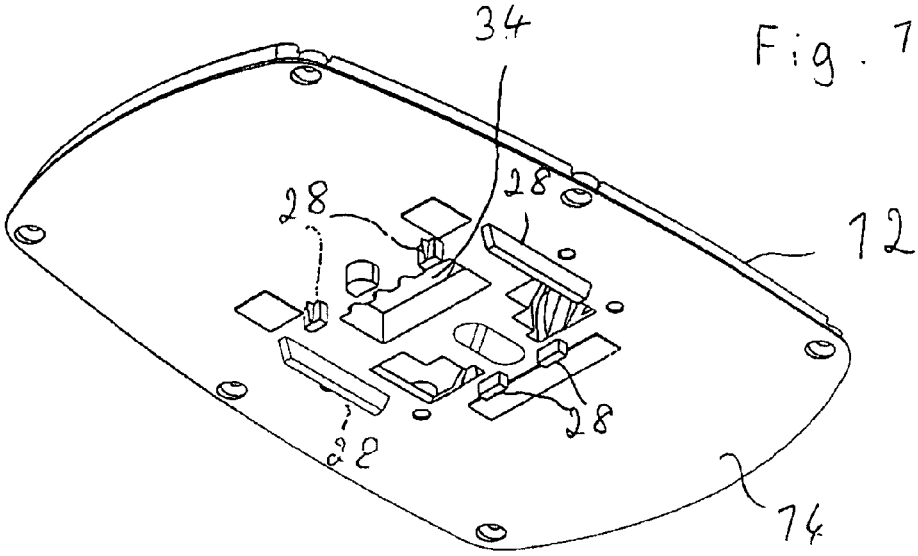
FIG. 12 shows a perspective view from below of an element included in the antenna unit shown in FIG. 1.
Figure 13:
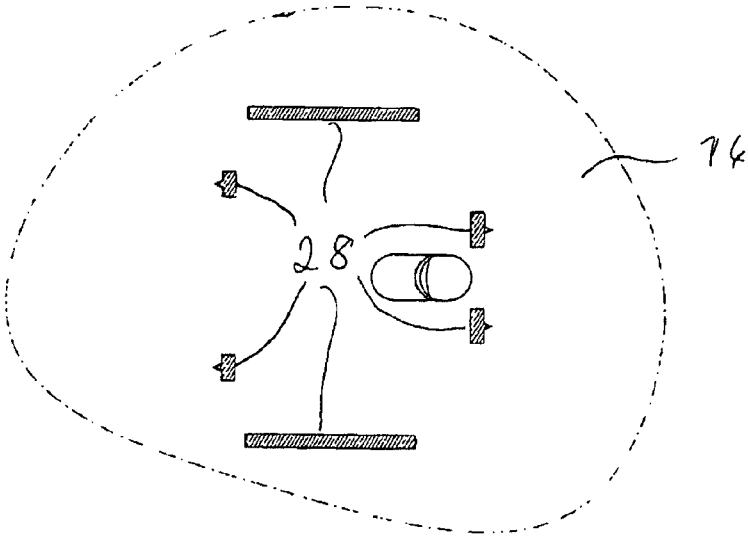
FIG. 13 is a side view of a chosen part of the underside of the element shown in FIG. 12.

In FIG. 12, a perspective view is shown from below of the element 12 included in the antenna unit 10 shown in FIG. 1. As is seen, the first side 14 comprises a number of mounting lugs 28, which are adapted to the hole in the mounting surface so that a mounted antenna unit 10 is positioned/aligned/located. In FIG. 13, said mounting lugs 28 are seen from below. In FIG. 12, it is also shown a member 34 for signal transfer between the first and the second side 14, 16 to/from antenna elements of the antenna unit 10. In this case, the member 34 is in the form of a hole 34 in the element 12 in which signal cables may be laid.

Figure 14:
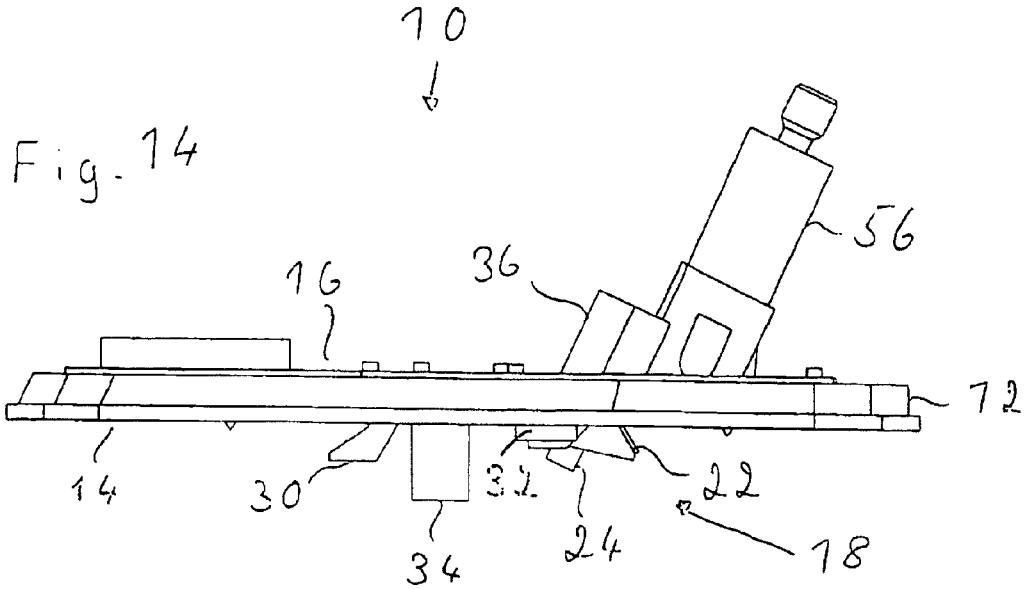
FIG. 14 is a side view of parts of a second embodiment of an antenna unit according to the present invention.
Figure 15:
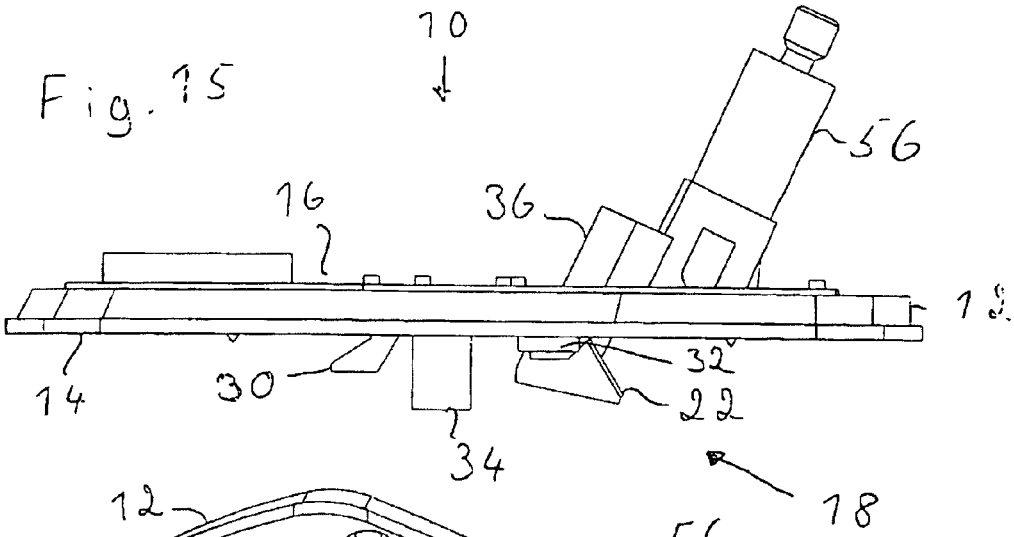
FIG. 15 is an additional side view of the parts of the antenna unit shown in 1*o* FIG. 14.

In FIG. 14, a side view shows parts of a second embodiment of an antenna unit 10 according to the present invention. Also this embodiment comprises an element 12 having a first side 14 and a second side 16. In this case, the antenna mount 18 comprises an elongate wedge member 30 that is fixedly arranged in the first side 14. The wedge member 30 is elongate in a plane transverse to the plane of the drawing and has a wedge-shaped cross-section in a plane parallel to the longitudinal direction of the antenna unit 10. As is seen in FIG. 14, the width of the wedge-shaped cross-section increases with the distance from the first side 14. Also the attachment member 22 has a wedge-shaped cross-section in a plane parallel to the longitudinal direction of the antenna unit 10 and is elongate in a plane perpendicular in relation to the longitudinal direction of the antenna unit 10. The width of the wedge-shaped cross-section is smallest closest to the first side 14 and greatest at the greatest distance from the first side 14. A fixing member 36 connected with the second side 16 is also shown in FIGS. 14 and 15. The bolt member 24 with the head thereof is arranged in the fixing member 36 and is arranged in a threaded hole in the attachment member 22. When the bolt member 22 is manipulated by means of the tool 26 (not shown), the bolt member 24 is linearly displaced along the bolt member 24. In FIG. 14, the second end position is shown when the attachment member 22 presses/clamps the antenna unit 10 against the first side of the mounting surface. In FIG. 15, there is, on the other hand, shown the first end position when the attachment member 22 has been displaced linearly along the bolt member 24 so that the distance between the attachment member 22 and the wedge member 30 has been decreased and thereby can be inserted into a hole intended therefor in the mounting surface. In FIGS. 14 and 15, an antenna mount 56 for an external radiator is also seen. In addition, a member 34 is shown for signal transfer between the first and the second side 14, 16 to/from antenna elements of the antenna unit 10. In this embodiment, the member 34 is in the form of lead-throughs/tubes in which connectors can be applied from each direction to establish contact for the signal transfer.

Figure 16:
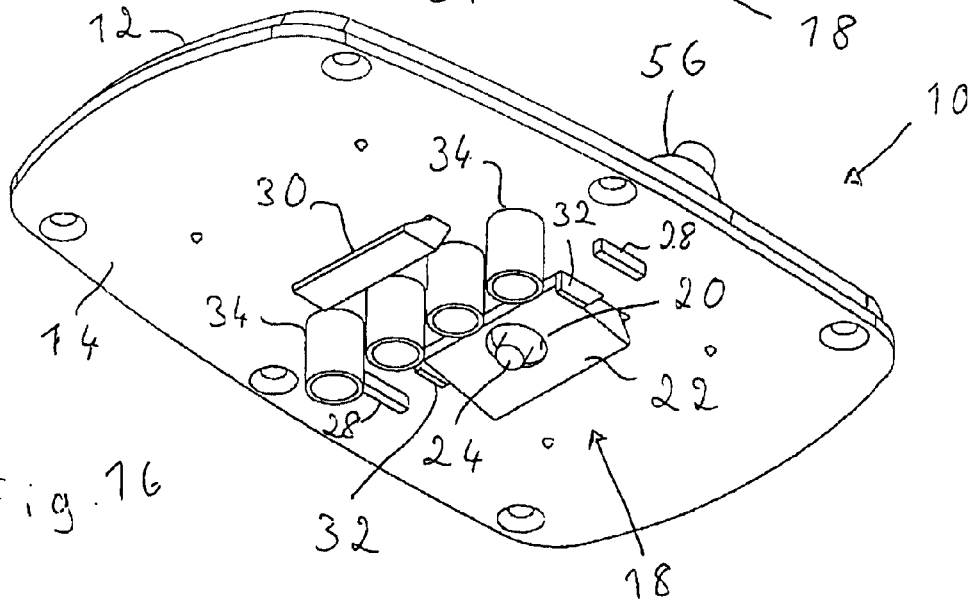
FIG. 16 shows a perspective view from below of the antenna unit shown in FIG. 14.

In FIG. 16, a perspective view from below shows the antenna unit 10 shown in FIG. 14. In this view, the look of the attachment member 22 and the wedge member 30 is clearly shown. The first side 14 comprises furthermore two lug members 32. As is seen in the figures, each lug member 32 is arranged abutting against the short sides of the attachment member 22. This entails that the attachment member 22 cannot rotate when the bolt member 24 is manipulated by the tool 26.

Figure 17:
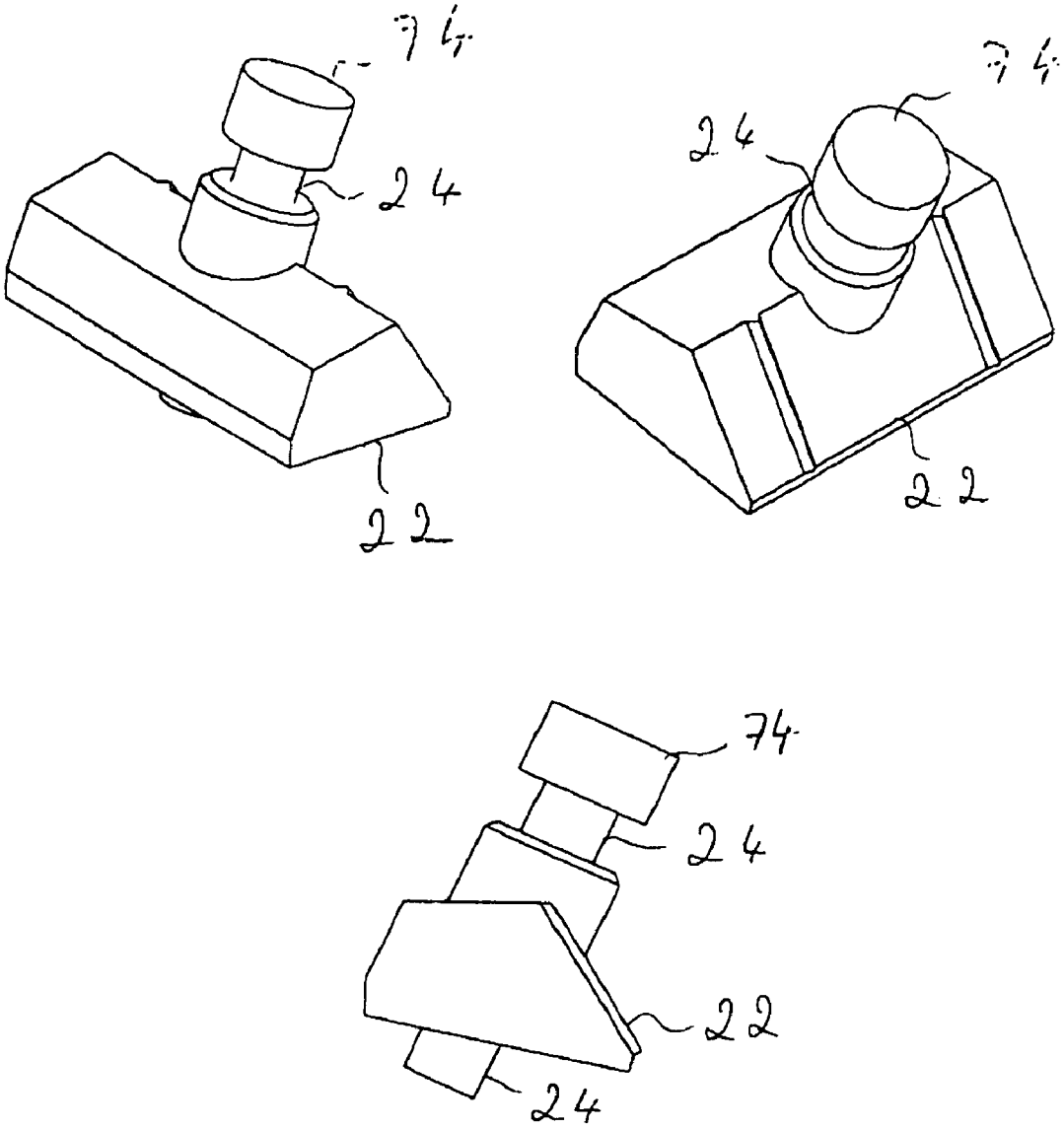
FIG. 17 shows two perspective views and a side view of an attachment member included in the antenna unit shown in FIG. 14.

In FIG. 17, the attachment member 22 is shown in the form of two different cross-sectional views and a side view. In addition, the bolt member 24 including the head 74 thereof is seen.

Figure 18:
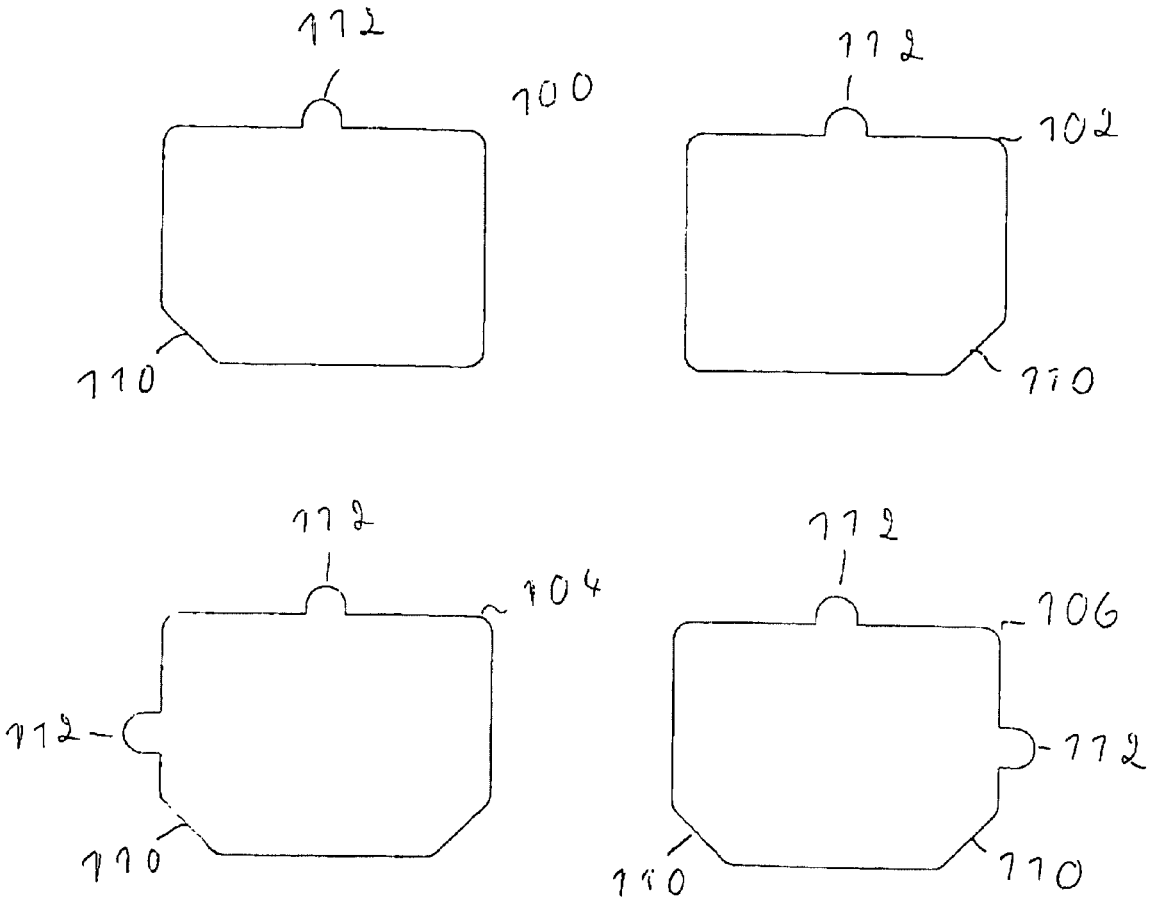
FIG. 18 shows examples of four different designs of the hole in the mounting surface.

In FIG. 18, four different examples show holes 100-106 in the mounting surface. The holes 100-106 are provided with truncated corners 110 placed in various ways. The holes 100-106 may also be provided with one or more projections 112 placed in various ways. By placing mounting lugs 28 on the first side 14 corresponding to the design of the hole 100-106, a so-called keying can be obtained. This means that an antenna unit 10 having a certain technical function obtains a certain set of mounting lugs 28, so that said antenna unit 10 only can be mounted in a certain hole, for instance 100, in the mounting surface.

It should be pointed out that the mounting surface may be situated on, for instance, a vehicle, container, alarm cabinet or a boat.

Even if the embodiments shown and described in the figures comprise a threaded hole for the bolt member 24, it is pointed out that the bolt member 24 also may be a self-tapping screw 24. For the various embodiments, this means that the attachment member 22 comprises a non-threaded hole 20 and that the cylinder member 58 comprises a non-threaded hole. These holes have hole dimensions adapted for the bolt member 24.

In addition, it is pointed out that the tool 26, for instance, may be a Hex head wrench, Torx key or another type of Bit key. It may also be various types of screwdrivers, such as slotted screwdriver or Phillips© screwdriver.

The invention is not limited to the embodiments described above. Many different modifications are feasible within the scope of the following claims.

The invention claimed is:

1. An antenna unit for mounting on a mounting surface from a first side of the mounting surface, which antenna unit comprises an element comprising a first side abutting against the mounting surface when the antenna unit is mounted, and a second side arranged parallel to and opposite the first side, characterized in that the antenna unit furthermore comprises an antenna mount comprising an attachment member provided with a threaded or non-threaded hole and arranged adjacent to the first side, as well as a bolt member provided with a thread and applied in the threaded or non-threaded hole, which head of the bolt member has a constant distance to the second side, which bolt member is manipulated by a tool from the first side of the mounting surface in such a way that the attachment member, in a first end position, is displaced in two dimensions in relation to the first side so that the attachment member is accessible through a hole intended therefor in the mounting surface, as well as a second end position, when the bolt member is arranged in relation to the first and second sides of the element at an angle, $\alpha<90°$, and the attachment member presses/clamps the antenna unit against the first side of the mounting surface.

2. Antenna unit for mounting on a mounting surface from a first side of the mounting surface according to claim 1, characterized in that the attachment member comprises a locking member arranged in the threaded or non-threaded hole so that the bolt member cannot be loosened from the attachment member, defining the first end position.

3. Antenna unit for mounting on a mounting surface from a first side of the mounting surface according to claim 1, characterized in that the bolt member is a self-tapping screw.

4. An antenna unit for mounting on a mounting surface from a first side of the mounting surface, which antenna unit comprises an element comprising a first side abutting against the mounting surface when the antenna unit is mounted, and a second side arranged parallel to and opposite the first side, characterized in that the antenna unit furthermore comprises an antenna mount comprising an attachment member provided with a threaded or non-threaded hole and arranged adjacent to the first side, as well as a bolt member provided with a thread and applied in the threaded or non-threaded hole, which head of the bolt member has a constant distance to the second side, which bolt member is manipulated by a tool from the first side of the mounting surface in such a way that the attachment member, in a first end position, is displaced in two dimensions in relation to the first side so that the attachment member is accessible through a hole intended therefor in the mounting surface, as well as a second end position, when the bolt member is arranged in relation to the first and second sides of the element at an angle, $\alpha<90°$, and the attachment member presses/clamps the antenna unit against the first side of the mounting surface, and in that the first side comprises mounting lugs adapted to the hole in the mounting surface so that a mounted antenna unit is positioned/aligned/located.

5. An antenna unit for mounting on a mounting surface from a first side of the mounting surface, which antenna unit comprises an element comprising a first side abutting against the mounting surface when the antenna unit is mounted, and a second side arranged parallel to and opposite the first side, characterized in that the antenna unit furthermore comprises an antenna mount comprising an attachment member provided with a threaded or non-threaded hole and arranged adjacent to the first side, as well as a bolt member provided with a thread and applied in the threaded or non-threaded hole, which head of the bolt member has a constant distance to the second side, which bolt member is manipulated by a tool from the first side of the mounting surface in such a way that the attachment member, in a first end position, is displaced in two dimensions in relation to the first side so that the attachment member is accessible through a hole intended therefor in the mounting surface, as well as a second end position, when the bolt member is arranged in relation to the first and second sides of the element at an angle, $\alpha<90°$, and the attachment member presses/clamps the antenna unit against the first side of the mounting surface, and in that the antenna mount furthermore comprises an elongate wedge member that is fixedly arranged in the first side and has a wedge-shaped cross-section in a plane parallel to the longitudinal direction of the antenna unit as well as is elongate in a plane perpendicular in relation to the longitudinal direction of the antenna unit, where the width of the wedge-shaped cross-section increases with the distance from the first side.

6. Antenna unit for mounting on a mounting surface from a first side of the mounting surface according to claim 5, characterized in that the attachment member has a wedge-shaped cross-section in a plane parallel to the longitudinal direction of the antenna unit and is elongate in a plane perpendicular in relation to the longitudinal direction of the antenna unit, where the width of the wedge-shaped cross-section is smallest closest to the first side and greatest at the greatest distance from the first side.

7. Antenna unit for mounting on a mounting surface from a first side of the mounting surface according to claim 6, characterized in that the first side furthermore comprises two lug members, each arranged abutting against the short sides of the attachment member having wedge-shaped cross-section, so that the attachment member does not rotate when the bolt member is manipulated by the tool.

8. Antenna unit for mounting on a mounting surface from a first side of the mounting surface according to claim 5, characterized in that the element comprises a member for signal transfer between the first and the second side to/from antenna elements of the antenna unit.

9. Antenna unit for mounting on a mounting surface from a first side of the mounting surface according to claim 5, characterized in that the bolt member with the head thereof is arranged in a fixing member connected with the second side and arranged in relation to the second side at the angle $\alpha<90°$, the attachment member being linearly displaced along the bolt member when this is manipulated by the tool.

10. An antenna unit for mounting on a mounting surface from a first side of the mounting surface, which antenna unit comprises an element comprising a first side abutting against the mounting surface when the antenna unit is mounted, and a second side arranged parallel to and opposite the first side, characterized in that the antenna unit furthermore comprises an antenna mount comprising an attachment member provided with a threaded or non-threaded hole and arranged adjacent to the first side, as well as a bolt member provided with a thread and applied in the threaded or non-threaded hole, which head of the bolt member has a constant distance to the second side, which bolt member is manipulated by a tool from the first side of the mounting surface in such a way that the attachment member, in a first end position, is displaced in two dimensions in relation to the first side so that the attachment member is accessible through a hole intended therefor in the mounting surface, as well as a second end position, when the bolt member is arranged in relation to the first and second sides of the element at an angle, $\alpha<90°$, and the attachment member presses/clamps the antenna unit against the first side of the mounting surface, and in that the attachment member comprises an abutment part provided with the non-threaded hole as well as two arm members, and in that the abutment part comprises a cylinder member movable in the abutment part, which cylinder member has a longitudinal axis direction perpendicular in relation to the longitudinal axis direction of the bolt member, and in that the cylinder member comprises a threaded hole that is arranged in the hole and in which the bolt member is applied, one end of each arm member being fixedly anchored in the abutment part on each side of the non-threaded hole in such a way that the arm members are arranged at an angle, $\beta<90°$, in relation to the plane of the abutment part that abuts against the mounting surface in the second end position, and in that each arm member comprises a first pin member each, either facing each other or facing away from each other, and in that the bolt member with the head thereof is arranged in a fixing member connected with the second side, which fixing member furthermore comprises two first guiding grooves facing away from each other and in which the first pin members are running.

11. Antenna unit for mounting on a mounting surface from a first side of the mounting surface according to claim 10, characterized in that the first guiding grooves describe a curve in such a way that the abutment plane of the abutment part, in the second end position, is parallel to the first side, and in that, in the first end position, the abutment plane of the abutment part is arranged at an angle, $\gamma<45°$, in relation to the first side and the bolt member is essentially, arranged perpendicularly in relation to the first side.

12. Antenna unit for mounting on a mounting surface from a first side of the mounting surface according to claim 10, characterized in that each arm member furthermore comprises a second pin member arranged on the opposite side of the arm member in relation to the first pin member, and in that the first pin member is displaced in the longitudinal direction of the arm member in relation to the second pin member, and in that the fixing member furthermore comprises two second guiding grooves facing away from each other and in which the second pin members are running.

13. Antenna unit for mounting on a mounting surface from a first side of the mounting surface according to claim 12, characterized in that the first pin members are smaller than the second pin members.

14. Antenna unit for mounting on a mounting surface from a first side of the mounting surface according to claim 13, characterized in that the first pin members face each other and the second pin members face away from each other and are arranged at one end of the arm members.

15. Antenna unit for mounting on a mounting surface from a first side of the mounting surface according to claim 14, characterized in that the first guiding grooves have a width that is smaller than the width of the second guiding grooves, and in that the second guiding grooves have a smallest width at the greatest distance from the first side and a greatest width adjacent to the first side and the first guiding grooves are of uniform width and describe an arch in relation to the second guiding grooves.

16. Antenna unit for mounting on a mounting surface from a first side of the mounting surface according to claim 15, characterized in that the antenna unit (furthermore comprises an outer part arranged on the fixing member and comprising interior guiding grooves, in which the second pin members furthermore are running.

17. Antenna unit for mounting on a mounting surface from a first side of the mounting surface according to claim 10, characterized in that the abutment part has an extension so that, in the second end position, the abutment part has contact points on opposite sides of the hole in the mounting surface.

* * * * *